US008748363B2

(12) United States Patent
Nagashima et al.

(10) Patent No.: US 8,748,363 B2
(45) Date of Patent: Jun. 10, 2014

(54) SOLVENT COMPOSITION FOR REMOVING RADIOACTIVE SUBSTANCE AND REMOVING MATERIAL, AND METHOD FOR REMOVING RADIOACTIVE SUBSTANCE

(71) Applicant: Du Pont-Mitsui Fluorochemicals Co., LTD., Tokyo (JP)

(72) Inventors: Kazuhito Nagashima, Tokyo (JP); Junichi Ishikawa, Tokyo (JP); Hideaki Kikuchi, Shizuoka (JP)

(73) Assignee: Du Pont-Mitsui Fluorochemicals Co., Ltd., Tokyo (JP)

( * ) Notice: Subject to any disclaimer, the term of this patent is extended or adjusted under 35 U.S.C. 154(b) by 193 days.

(21) Appl. No.: 13/667,970

(22) Filed: Nov. 2, 2012

(65) Prior Publication Data

US 2013/0072409 A1 Mar. 21, 2013

Related U.S. Application Data

(63) Continuation of application No. 11/997,278, filed as application No. PCT/JP2005/013941 on Jul. 29, 2005, now abandoned.

(51) Int. Cl.

| | |
|---|---|
| ***G21F 9/00*** | (2006.01) |
| ***C11D 11/00*** | (2006.01) |
| *C11D 3/43* | (2006.01) |
| *C11D 7/30* | (2006.01) |
| *G21F 9/28* | (2006.01) |

(52) U.S. Cl.

CPC ..... *C11D 11/0023* (2013.01); *C11D 3/43* (2013.01); *C11D 7/30* (2013.01); *G21F 9/001* (2013.01); *G21F 9/28* (2013.01)

USPC ..... 510/110; 134/22.19

(58) Field of Classification Search

CPC ..... C02F 2101/006; C11D 11/0023; C11D 3/43; C11D 7/30; G21F 9/001; G21F 9/28

USPC ..... 588/1; 210/682; 510/110; 134/22.19

See application file for complete search history.

(56) References Cited

U.S. PATENT DOCUMENTS

| | | | | |
|---|---|---|---|---|
| 4,595,529 | A * | 6/1986 | Neace | 252/364 |
| 5,466,877 | A | 11/1995 | Moore | |
| 5,678,231 | A * | 10/1997 | Mouk et al. | 588/1 |
| 5,827,812 | A | 10/1998 | Flynn et al. | |
| 6,008,179 | A | 12/1999 | Flynn et al. | |
| 6,277,807 | B1 | 8/2001 | Flynn et al. | |
| 6,288,017 | B1 | 9/2001 | Flynn et al. | |
| 6,312,759 | B1 | 11/2001 | Yamada et al. | |
| 6,313,083 | B1 | 11/2001 | Flynn et al. | |
| 6,394,107 | B1 | 5/2002 | Kesari et al. | |
| 6,426,327 | B1 | 7/2002 | Flynn et al. | |
| 6,699,829 | B2 | 3/2004 | Doyel et al. | |
| 7,244,276 | B2 | 7/2007 | Evers et al. | |
| 7,288,511 | B2 | 10/2007 | Doyel et al. | |
| 7,452,383 | B2 | 11/2008 | Evers et al. | |
| 7,452,384 | B2 | 11/2008 | Evers et al. | |
| 7,462,203 | B2 | 12/2008 | Goldoni et al. | |
| 7,488,352 | B2 | 2/2009 | Evers et al. | |
| 7,494,629 | B2 * | 2/2009 | Kaiser | 422/292 |
| 7,497,877 | B2 | 3/2009 | Goedhart et al. | |
| 2003/0049187 | A1 * | 3/2003 | Kaiser | 422/292 |
| 2003/0087782 | A1 | 5/2003 | Evers et al. | |
| 2003/0089877 | A1 | 5/2003 | Rivers et al. | |
| 2003/0097718 | A1 | 5/2003 | Evers et al. | |
| 2003/0102007 | A1 * | 6/2003 | Kaiser | 134/1 |
| 2003/0168764 | A1 | 9/2003 | Nishida et al. | |
| 2003/0228997 | A1 | 12/2003 | Doyel et al. | |
| 2004/0086650 | A1 | 5/2004 | Behr et al. | |
| 2004/0224870 | A1 | 11/2004 | Doyel et al. | |
| 2005/0126606 | A1 | 6/2005 | Goedhart et al. | |
| 2005/0132502 | A1 | 6/2005 | Goldoni et al. | |
| 2005/0132508 | A1 | 6/2005 | Overdevest | |
| 2005/0133462 | A1 | 6/2005 | Goldoni et al. | |
| 2005/0137116 | A1 | 6/2005 | Overdevest | |
| 2006/0048307 | A1 | 3/2006 | Evers et al. | |
| 2006/0080786 | A1 | 4/2006 | Evers et al. | |
| 2006/0128583 | A1 | 6/2006 | Evers et al. | |
| 2006/0180785 | A1 | 8/2006 | Merchant et al. | |
| 2006/0200914 | A1 | 9/2006 | Evers et al. | |
| 2007/0012617 | A1 | 1/2007 | Suzuki et al. | |
| 2009/0010824 | A1 * | 1/2009 | Kaiser | 422/292 |
| 2009/0117165 | A1 * | 5/2009 | Kaiser | 424/411 |
| 2010/0252066 | A1 * | 10/2010 | Kaiser | 134/1 |

FOREIGN PATENT DOCUMENTS

| | | |
|---|---|---|
| EP | 0 496 899 | 5/1992 |
| JP | 05-508418 | 11/1993 |
| JP | 06-184778 | 7/1994 |
| JP | 07-275496 | 10/1995 |
| JP | 10-197693 | 7/1998 |
| JP | 10-510579 | 10/1998 |
| JP | 11-035991 | 2/1999 |
| JP | 11-505249 | 5/1999 |
| JP | 2002-146271 | 5/2002 |
| JP | P3482488 | 10/2003 |

(Continued)

OTHER PUBLICATIONS

U.S. Appl. No. 11/997,278, Apr. 25, 2012, Office Action.

U.S. Appl. No. 11/997,278, Sep. 6, 2012, Office Action.

Radioisotopes, magazine, P. 57-62, vol. 23, No. 12 (1974), issued by the Japan Radioisotope Association (only pertinent part is translated).

Office Action issued in related Japanese Application No. 2010-000174, mailed Mar. 22, 2011, with English translation.

*Primary Examiner* — Gregory Webb

(74) *Attorney, Agent, or Firm* — Workman Nydegger

(57) ABSTRACT

The present invention relates to a solvent composition for removing radioactive substance, characterized by comprising at least one selected from hydrofluorocarbon, hydrofluoroether, and perfluoroketone as a medium for transporting the radioactive substance, and a method for removing a radioactive substance characterized by using the solvent composition for removing.

2 Claims, No Drawings

(56) References Cited

FOREIGN PATENT DOCUMENTS

| | | |
|---|---|---|
| JP | 2005-048097 | 2/2005 |
| WO | WO 92/06941 | 4/1992 |
| WO | WO 96/36688 | 11/1996 |
| WO | WO 96/36689 | 11/1996 |

* cited by examiner

SOLVENT COMPOSITION FOR REMOVING RADIOACTIVE SUBSTANCE AND REMOVING MATERIAL, AND METHOD FOR REMOVING RADIOACTIVE SUBSTANCE

CROSS-REFERENCE TO RELATED APPLICATIONS

This application claims priority to U.S. patent application Ser. No. 11/997,278, filed on Jan. 29, 2008, which is a United States national stage of Patent Cooperation Treaty application PCT/JP2005/013941, filed on Jul. 29, 2005, the contents of which are hereby incorporated by reference.

BACKGROUND OF THE INVENTION

1. The Field of the Invention

The present invention relates to a method for simply removing a low-concentration radioactive substance, a removing material suitable for the method, and a solvent composition for removing.

2. The Relevant Technology

At present, it is considered that materials exposed to radiation in nuclear power plants or the like can be subjected to waste treatment when radioactive substance is removed at a low-concentration level of residual contamination with radioactive substance, where contamination is hardly observed (clearance level). However, since equipment and tools are used under the condition that they are reused, the following methods have been applied: a gentle removal method that does not damage materials; and a method of wiping contaminated parts with a cloth piece moistened with water or a removing agent with little chemical reaction (such as alcohol, acetone, and a synthetic detergent) (refer to Non-Patent Document 1). Even at present, the removal work is done mainly by wiping, for example, with a disposable towel like Kimtowel (manufactured by Nippon Paper Crecia Co., Ltd.) immersed with a 50% by volume aqueous solution of ethanol. However, the current removing material (Kimtowel immersed with a 50% by volume aqueous solution of ethanol) has insufficient removing performance and requires repeated wiping operations. In addition, the cleanliness after wiping depends largely on a worker's impression. Moreover, removing materials can be discarded only after they are dried. Therefore, the use of a disposable towel immersed with a 50% by volume aqueous solution of ethanol, which has poor drying properties, requires drying treatment of a wiped-off surface and the disposable towel before discarded, after wiping. Further, the 50% by volume aqueous solution of ethanol also has a problem against inflammability.

Patent Document 1: Japanese Patent Application Laid-Open No. 5-508418.

Patent Document 2: Japanese Patent No. 3482488.

Patent Document 3: U.S. Pat. No. 5,466,877.

Non-Patent Document 1: "RADIOISOTOPES" magazine, pp. 57-62, vol. 23, No. 12, (1974), issued by the Japan Radioisotope Association.

DETAILED DESCRIPTION OF THE PREFERRED EMBODIMENTS

The present invention was made in consideration of such a situation, and an object of the present invention is to provide a method for removing a low-concentration radioactive substance simply, a removing material suitable for the removal, and a solvent composition for removing. As a result of intensive research to solve the above problems, the present inventors have found that a removing material immersed with a solvent composition for removing, comprising at least one selected from hydrofluorocarbon, hydrofluoroether, and perfluoroketone as a medium for transporting a radioactive substance is effective for the removal of a radioactive substance. A removing material in which a wipe substrate is immersed with a solvent composition for removing of the present invention (hereinafter referred to as "a removing wiper") is particularly excellent in the removing performance (removal effect) and can substantially reduce the wiping work, which is currently performed repeatedly several times. Further, since the solvent composition for removing of the present invention has excellent drying properties, the time required for the drying that is currently performed after wiping work can be substantially shortened or omitted. Furthermore, since the removing solvent composition of the present invention is inflammability, it can also eliminate the danger of ignition.

One aspect of the present invention is a solvent composition for removing radioactive substance characterized by comprising at least one selected from hydrofluorocarbon, hydrofluoroether, and perfluoroketone as a medium for transporting the radioactive substance. Hydrofluoroether or perfluoroketone preferably has 4 to 8 carbon atoms. Specifically, the hydrofluorocarbon is preferably $C_2H_2F_{10}$, $C_4H_5F_5$, c-$C_5H_3F_7$, or $C_7HF_{15}$. Further, the hydrofluoroether is preferably $C_4F_9OCH_3$, $C_4F_9OC_2H_5$, $C_2HF_4OC_2H_2F_3$, or $F(CF(CF_3)CF_2O)CHFCF_3$. Furthermore, the perfluoroketone is preferably $CF_3CF_2C(O)CF(CF_3)_2$, $(CF_3)_2CFC(O)CF(CF_3)_2$, or $(CF_3)_2CFCF_2C(O)CF(CF_3)_2$.

The solvent composition for removing radioactive substance according to the present invention can further comprise at least one organic solvent selected from alcohol, ketone, ether, ester, hydrocarbon, halogenated hydrocarbon, glycol ether, or a silicone-based organic solvent. Among these, it is preferred that the composition comprise alcohol. As the alcohol, it is preferred to use methanol, ethanol, 1-propanol, 2-propanol, 1-butanol, 2-butanol, t-butanol, or a mixture thereof. The organic solvent can be contained in an amount of from 1 to 50% by weight based on the total weight of the removing solvent composition.

Another aspect of the present invention is a material for removing radioactive substance, characterized in that the material is immersed with a removing solvent composition comprising at least one selected from hydrofluorocarbon, hydrofluoroether, and perfluoroketone as a medium for transporting a radioactive substance. The removing material of the present invention can be prepared by immersing a wipe substrate with the solvent composition for removing of the present invention. It is preferred to use a nonwoven fabric as a wipe substrate. Further, it is preferred to use a wipe substrate comprising at least one selected from pulp, synthetic fiber, cellulose, and regenerated cellulose.

Still another aspect of the present invention is a method for removing a radioactive substance, characterized by using at least one selected from hydrofluorocarbon, hydrofluoroether, and perfluoroketone as a medium for transporting the radioactive substance. Further, the present invention is a method for removing a radioactive substance, characterized by comprising the steps of: bringing a surface of an article with the radioactive substance adhered thereto into contact with a removing material immersed with the solvent composition for removing of the present invention; and adsorbing the radioactive substance to the removing material, thereby recovering the radioactive substance. As the removing material, the removing wiper according to the present invention can be used.

Hereinafter, the present invention is described in detail.

(1) Solvent Composition for Removing of the Present Invention

The solvent composition for removing radioactive substance according to the present invention comprises at least one selected from hydrofluorocarbon, hydrofluoroether, and perfluoroketone as a medium for transporting a radioactive substance. In the present invention, the optimum medium for transporting a radioactive substance is selected from at least one selected from hydrofluorocarbon, hydrofluoroether, and perfluoroketone depending on the type of contamination, the type of contaminees, and the like. The solvent composition for removing is preferably a liquid at room temperature (has a boiling point at room temperature or above), preferably having a boiling point of 30° C. to 100° C., and it preferably has 4 to 8 carbon atoms. From a viewpoint of safety, the compound having low level of toxicity, preferably, 100 ppm or more of permissible concentration level (ppm (Vol)) is used. Further, similarly, the compound having low inflammability, preferably no flash point (according to JIS K2265) is used. Furthermore, the compound having a low global warming potential (GWP) is preferably used from an environmental point of view. An increase in the number of fluorine atoms in compound results in an increase in non-inflammability, and an increase in the molecular weight tends to raise a boiling point. Thus, a compound may be suitably selected according to the purpose. For example, in order to improve drying properties, a compound having a small molecular weight may be used, or it may be mixed with a highly volatile organic solvent or the like.

(a) Hydrofluorocarbon (HFC)

Examples of the hydrofluorocarbons used in the present invention include 1,1,1,2,2,3,4,5,5,5-decafluoropentane, 1,1,1,3,3-pentafluorobutane, 1,1,2,2,3,3,4-heptafluorocyclopentane, and 1H-perfluoroheptane. Among these hydrofluorocarbons, $C_5H_2F_{10}$, $C_4H_5F_5$, c-$C_5H_3F_7$, or $C_7HF_{15}$ is preferred in terms of the removal effect and having a boiling point of from 30° C. to 100° C., no flash point, and low toxicity. The above hydrofluorocarbons may be used alone or in combination of two or more. These hydrofluorocarbons can be prepared by a known method; or those commercially available may be used; or they may be produced, for example, using a method described in Patent Document 1.

(b) Hydrofluoroether (HFE)

Examples of the hydrofluoroethers used in the present invention include $CF_3CF_2CH_2OCHF_2$, $CF_3CHFCF_2OCH_3$, $CF_3CH_2OCF_2CH_2F$, $CF_3CHFCF_2OCH_2CF_3$, nonafluorobutyl methyl ether, nonafluorobutyl ethyl ether, 1,1,2,2-tetrafluoroethyl-2,2,2-trifluoroethyl ether, and 2H-perfluoro(5-methyl-3,6-dioxanonane). Among these hydrofluoroethers, $C_4F_9OCH_3$, $C_4F_9OC_2H_5$, $C_2HF_4OC_2H_2F_3$, or $F(CF(CF_3)CF_2O)CHFCF_3$ is preferred in terms of the removal effect and having a boiling point of from 30° C. to 100° C., no flash point, and low toxicity. These hydrofluoroethers can be prepared by a known method; or those commercially available may be used; or they may be produced, for example, using a method described in Patent Document 2. These hydrofluoroethers may be used alone or in combination of two or more.

(c) Perfluoroketone

Examples of the perfluoroketones used in the present invention include $CF_3(CF_2)_5C(O)CF_3$, $CF_3CF_2CF_2C(O)CF_2CF_2CF_3$, $CF_3CF_2C(O)CF(CF_3)_2$, $(CF_3)_2CFC(O)CF(CF_3)_2$, $(CF_3)_2CFCF_2C(O)CF(CF_3)_2$, $CF_3(CF_2)_2C(O)CF(CF_3)_2$, $CF_3(CF_2)_3C(O)CF(CF_3)_2$, $CF_3CF_2C(O)CF_2CF_2CF_3$, and $CF_3OCF_2C(O)CF(CF_3)_2$. Among these hydrofluoroethers, $CF_3CF_2C(O)CF(CF_3)_2$ is preferred in terms of the removal effect and having a boiling point of from 30° C. to 100° C., no flash point, and low toxicity. These perfluoroketones can be prepared by a known method; or those commercially available may be used; or they may be produced, for example, using a method described in Patent Document 3. These perfluoroketones may be used alone or in combination of two or more.

Further, in the present invention, hydrofluorocarbon, hydrofluoroether, and perfluoroketone used as a medium for transporting a radioactive substance may be used alone or in combination of two or more.

To the solvent composition for removing of the present invention, in order to further improve the removal performance, may be added an organic solvent such as alcohol, ketone, ether, ester, hydrocarbon, halogenated hydrocarbon, glycol ether, and a silicone-based organic solvent. Examples of alcohol include methanol, ethanol, 1-propanol, 2-propanol, 1-butanol, 2-butanol, and t-butanol. Examples of ketone include acetone and methyl ethyl ketone. Examples of ether include diethyl ether. Examples of ester include methyl acetate and ethyl acetate. Examples of hydrocarbon include hexane, heptane, and isooctane. Examples of halogenated hydrocarbon include trans-1,2-dichloroethylene and 1,1-dichloro-2,2,3,3,3-pentafluoropropane. Examples of silicone-based organic solvent include hexamethyldisiloxane. Examples of glycol ether include 1,2-diethoxyethane. These organic solvents may be used alone or in combination of two or more. Inflammable organic solvents such as alcohol, ether, and the like are preferably used in relatively low concentrations. The amount of these organic solvents to be added may be appropriately set in terms of inflammable, compatibility, and the like, but these organic solvents can be added in a proportion of 1 to 50%, preferably 2 to 30%, more preferably 3 to 15%, by weight, relative to the total weight of the solvent composition for removing.

When an alcohol is used as an organic solvent, an increase in the amount of alcohol to be added increases the removal effect, but it tends to increase the time until the used removing solvent composition dries. Therefore, it is preferred to add an alcohol in a proportion of 2 to 30%, more preferably 3 to 15%, by weight, relative to the total weight of the removing solvent composition.

Next, the material for removing the radioactive substance of the present invention is described.

(2) Material for Radioactive Substance of the Present Invention

The material for removing radioactive substance of the present invention is characterized by comprising at least one selected from hydrofluorocarbon, hydrofluoroether, and perfluoroketone. The removing material of the present invention is preferably a removing wiper prepared by immersing a wipe substrate with the above removing solvent composition of the present invention. Note that, in the present invention, a "wiper" means the generic name of what is used for wiping the surface of an article.

The wipe substrate is not particularly limited as far as it holds a liquid removing solvent composition of the present invention and comprises a material that can be used for wiping the surface of an article. However, it is preferred to use the one comprising of at least one selected from pulp, synthetic fiber, cellulose, and regenerated cellulose in terms of availability and cost. The form of a wipe substrate is not particularly limited as far as the substrate is processed from the above materials, but it is preferred to use a form that can maintain a certain degree of strength when it is used for wiping. It is preferred to use a nonwoven fabric in that it has high wiping effect and fibers are hard to remain.

The nonwoven fabric to be used is not particularly limited, but the most suitable one can be selected depending on the type of contamination, the type of contaminees, and the like. Examples include pulp, pulp/synthetic fiber, pulp/rayon, pulp/synthetic fiber/rayon, rayon, rayon/synthetic fiber, pulp/lyocell, pulp/synthetic fiber/lyocell, lyocell, lyocell/synthetic fiber, synthetic fiber, and cotton yarn. Examples of synthetic fiber include polyethylene terephthalate, polybutylene terephthalate, nylon and/or polyolefines such as polypropylene, polyethylene, and poly-4-methyl-1-pentene.

The thickness of a nonwoven fabric can be suitably selected depending on the application of the removing wiper of the present invention, and it is generally preferably from about 10 μm to about 3 mm. Further, the mass per unit area of a nonwoven fabric can be suitably selected depending on the application, and it is generally preferably from 10 to 500 $g/m^2$.

A method for manufacturing a nonwoven fabric used for the removing wiper of the present invention is not particularly limited, but the nonwoven fabric can be manufactured by generally used methods such as water jetting, needle punching, stitch bonding, chemical bonding, thermal bonding, spun-bonding, meltblowing, and wet process.

Further, the wipe substrate for the removing wiper of the present invention is not limited to a fabric form as described above, but a wipe substrate having a porous structure such as sponge may be used.

In the present invention, a method for immersing a wipe substrate with a solvent composition for removing is not particularly limited, but it can be performed by a generally used method, for example, by immersing a wipe substrate in a solvent composition for removing or by spraying a solvent composition for removing onto a wipe substrate.

(3) A Method for Removing a Radioactive Substance According to the Present Invention A method for removing a radioactive substance according to the present invention is characterized by using at least one selected from hydrofluorocarbon, hydrofluoroether, and perfluoroketone as a medium for transporting a radioactive substance. As a medium for transporting a radioactive substance, a suitable composition can be appropriately selected and used according to the description about the solvent composition for removing of the present invention as described above.

Further, the present invention is a method for removing a radioactive substance, characterized by comprising the steps of: bringing a surface of an article with a radioactive substance adhered thereto into contact with a removing material immersed with the solvent composition for removing of the present invention; and adsorbing the radioactive substance to the removing material, thereby recovering the radioactive substance. As a removing material, the removing wiper according to the present invention can be used. In the step of bringing a surface of an article with a radioactive substance adhered thereto into contact with a removing material immersed with the solvent composition for removing of the present invention, the method for bringing the removing material into contact is not particularly limited, but a larger amount of the radioactive substance can be adsorbed to the removing material as the area of contact with the surface of the article with the radioactive substance adhered thereto becomes larger.

Next, the evaluation method of the solvent composition for removing of the present invention is described below.

(Evaluation of the Removal Solvent Composition)

The solvent composition for removing of the present invention was evaluated for the following points 1 to 3.

1. Test for confirming removal: Level of removal was evaluated by measuring the amount of hematite ($Fe_2O_3$), which is recognized as a simulated material of a radioactive contaminant, adhering to a wipe substrate immersed with a solvent composition for removing.

Specifically, the weight (A) of a wipe substrate (Sontara (registered trademark), a rayon/polyester mixed product manufactured by Du Pont Kabushiki Kaisha) or Kimtowel (100% pulp, manufactured by Nippon Paper Crecia Co., Ltd.) having an area of 70 $cm^2$ was measured first. Then, a wipe substrate immersed with a solvent composition for removing shown in Table 2 was attached to a fixture and a weight (500 g) was put on the fixture. The wipe substrate was moved 500 mm on a surface to be removed (No. 1 finished-surface of SUS 304 stainless steel; weight of a simulated material adhered: 0.3 $mg/cm^2$) which is previously applied, as a radioactive contaminant, with hematite ($Fe_2O_3$) (obtained by heat-treating iron (III) oxide manufactured by Kanto Chemical Co., Inc. at 600° C.), which is recognized as a simulated material of a radioactive contaminant. Then, the wipe substrate was removed from the fixture and dried for two days at room temperature, and the weight (B) of the wipe substrate after drying was measured. The ratio of the contaminant adhered to the wipe substrate [(B−A)/area of wipe substrate (70 $cm^2$)] was determined from the difference of the weight (B−A) measured in this way.

2. Drying test: The wipe substrate was immersed with a solvent composition for removing, put on a balance at room temperature, and measured for the time until it dries. Thus, drying properties were evaluated.

3. Non-inflammability test: The flame of a lighter was brought close to a glass petri dish in which a solvent composition for removing was put, and non-inflammability was evaluated by whether the solvent composition ignites or not.

Examples of the present invention are described below, but the present invention is not limited to the inventions disclosed in Examples.

EXAMPLES

In Examples, the solvent compositions for removing shown in Table 1 were evaluated.

TABLE 1

| Solvent compositions for removing | Trade name |
|---|---|
| 1,1,1,2,2,3,4,5,5,5-decafluoropentane | Vertrel (registered trademark) XF, manufactured by Du Pont-Mitsui Fluorochemicals Company, Ltd. |
| Mixture of 96 wt % of 1,1,1,2,2,3,4,5,5,5-decafluoropentane and 4 wt % of ethanol | Vertrel (registered trademark) XE, manufactured by Du Pont-Mitsui Fluorochemicals Company, Ltd. |
| Nonafluorobutyl methyl ether | Novec 7100 (registered trademark) manufactured by 3M Limited |
| Nonafluorobutyl ethyl ether | Novec 7200 (registered trademark) manufactured by 3M Limited |
| Mixture of 90 wt % of 1,1,1,2,2,3,4,5,5,5-decafluoropentane and 10 wt % of ethanol | Vertrel (registered trademark) X-E10, manufactured by Du Pont-Mitsui Fluorochemicals Company, Ltd. |

Example 1

Decontaminability Test

The test for confirming removal was performed using Vertrel (registered trademark) XF, Vertrel (registered trademark)

XE, Vertrel (registered trademark) X-E10, Novec 7100 (registered trademark) (manufactured by 3M Limited), and Novec 7200 (registered trademark) (manufactured by 3M Limited) as solvent compositions for removing; and a non-woven fabric (Sontara (registered trademark), a rayon/polyester mixed product manufactured by Du Pont Kabushiki Kaisha) as wipe substrates. The results are shown in Table 2.

Comparative Example 1

The test for confirming removal was performed by the same operation as in Example 1 except that a 50% by volume aqueous solution of ethanol was used as a solvent composition for removing and Kimtowel was used as a wipe substrate. The results are shown in Table 2.

TABLE 2

| Wipe substrate contamination ratio | |
|---|---|
| Solvent compositions for removing | The amount wiped off, mg/cm$^2$ |
| Vertrel (registered trademark) XF | 0.679 |
| Vertrel (registered trademark) XE | 0.834 |
| Vertrel (registered trademark) X-E10 | 1.393 |
| Novec 7100 (registered trademark) | 1.061 |
| Novec 7200 (registered trademark) | 0.890 |
| 50 vol % aqueous ethanol solution | 0.636 |

Example 2

Drying Test

The drying test was performed using Vertrel (registered trademark) XF, Vertrel (registered trademark) XE, and Vertrel (registered trademark) X-E10 as solvent compositions for removing and Kimtowel (manufactured by Nippon Paper Crecia Co., Ltd.) as a wipe substrate.

Kimtowel cut to a 50 mm square (0.05 g) was immersed in Vertrel (registered trademark) XF, Vertrel (registered trademark) XE, or Vertrel (registered trademark) X-E10 for 1 minute. Then, the resulting Kimtowel was transferred to a balance and measured for the time until its weight returns to the initial weight of the wipe substrate. The drying time of the solvent composition for removing is shown in Table 3.

Comparative Example 2

In this Comparative Example, the same operation as in Example 2 was performed using a 50% by volume aqueous solution of ethanol instead of the solvent composition for removing. Drying time is shown in Table 3.

TABLE 3

| Drying time | |
|---|---|
| Solvent compositions for removing | The amount wiped off, mg/cm$^2$ |
| Vertrel (registered trademark) XF | 57 |
| Vertrel (registered trademark) XE | 68 |

TABLE 3-continued

| Drying time | |
|---|---|
| Solvent compositions for removing | The amount wiped off, mg/cm$^2$ |
| Vertrel (registered trademark) X-E10 | 130 |
| 50 vol % aqueous ethanol solution | 2803 |

Example 3

Non-Inflammability Test

At room temperature, 20 ml of Vertrel (registered trademark) X-E10 was put in a glass petri dish having an inner diameter of 85 mm. When the flame of a lighter was brought close to the upper surface of the petri dish, the flame went out.

Comparative Example 3

At room temperature, 20 ml of a 50% by volume aqueous solution of ethanol was put in a glass petri dish having an inner diameter of 85 mm in the same manner as in Example 3. When the flame of a lighter was brought close to the upper surface of the petri dish, the solution continued burning on the liquid surface with a blue flame even after the flame of the lighter is removed.

INDUSTRIAL APPLICABILITY

The present invention provides a solvent composition that exhibits excellent removal effect in the work for removing a radioactive substance from the equipment and the like with the radioactive substance adhered thereto in nuclear power plants, hospitals, airplanes, and the like. In addition, since the solvent composition has excellent evaporation properties from the equipment and the like after the removal work, it allows the treatment after removal to be done easily.

What is claimed is:

1. A method comprising:

preparing a solvent composition which consists essentially of: hydrofluorocarbon as a vehicle for transporting the radioactive substance, wherein said hydrofluorocarbon is $C_5H_2F_{10}$, $C_4H_5F_5$, c-$C_5H_3F_7$, or $C_7HF_{15}$, and wherein the solvent composition further comprises 3 to 15% by weight of ethanol based on the total weight of the solvent composition; and removing a radioactive substance using the solvent composition.

2. A method comprising:

preparing a solvent composition which consists essentially of: hydrofluorocarbon as a vehicle for transporting the radioactive substance, wherein said hydrofluorocarbon is $C_5H_2F_{10}$, $C_4H_5F_5$, c-$C_5H_3F_7$, or $C_7HF_{15}$, and wherein the solvent composition further comprises 3 to 15% by weight of alcohol based on the total weight of the solvent composition, the alcohol being selected from the group consisting of: methanol, ethanol, 1-propanol, 2-propanol, 1-butanol, 2-butanol, and t-butanol, and any mixtures thereof; and removing a radioactive substances using the solvent composition.

* * * * *